US011771944B2

(12) United States Patent
Susko et al.

(10) Patent No.: US 11,771,944 B2
(45) Date of Patent: Oct. 3, 2023

(54) RETRACTABLE EXERCISE SYSTEM

(71) Applicant: Susko Engineering, LLC, Goleta, CA (US)

(72) Inventors: Tyler Susko, Goleta, CA (US); Nathan Lawrie, North Kingstown, RI (US); Dean Anthony Passanisi, Jr., Brownsville, TX (US)

(73) Assignee: SUSKO ENGINEERING, LLC, Goleta, CA (US)

( * ) Notice: Subject to any disclaimer, the term of this patent is extended or adjusted under 35 U.S.C. 154(b) by 0 days.

(21) Appl. No.: 17/976,386

(22) Filed: Oct. 28, 2022

(65) Prior Publication Data

US 2023/0166151 A1 Jun. 1, 2023

Related U.S. Application Data

(60) Provisional application No. 63/284,157, filed on Nov. 30, 2021.

(51) Int. Cl.
*A63B 21/00* (2006.01)
*A63B 21/078* (2006.01)

(52) U.S. Cl.
CPC ..... *A63B 21/4029* (2015.10); *A63B 21/078* (2013.01); *A63B 2210/50* (2013.01)

(58) Field of Classification Search
CPC ..... A63B 21/00047; A63B 21/078; A63B 21/154; A63B 21/4027; A63B 21/5029; A63B 21/4031; A63B 21/4033; A63B 21/4039; A63B 2210/50; A63B 2210/58
See application file for complete search history.

(56) References Cited

U.S. PATENT DOCUMENTS

| | | | | |
|---|---|---|---|---|
| 4,456,246 | A | 6/1984 | Szabo | |
| 4,564,194 | A | 1/1986 | Dawson | |
| 4,624,457 | A | 11/1986 | Silberman | |
| 4,634,127 | A | 1/1987 | Rockwell | |
| 4,645,196 | A | 2/1987 | Christie | |
| 5,551,936 | A | 9/1996 | Parisi | |
| 5,882,283 | A * | 3/1999 | Stevens | A63B 21/4029 482/142 |
| 5,921,897 | A * | 7/1999 | Stevens | A63B 21/4029 482/142 |
| 6,645,130 | B2 | 11/2003 | Webber | |
| 7,048,677 | B2 | 5/2006 | Mackert | |
| 10,150,024 | B1 * | 12/2018 | Esparza | A63B 21/023 |
| 10,195,479 | B2 | 2/2019 | Brasch | |
| 10,737,134 | B2 | 8/2020 | Anderson | |
| 11,058,936 | B1 * | 7/2021 | Brasch | A63B 71/04 |
| 11,446,539 | B1 * | 9/2022 | Brasch | A63B 21/4029 |

(Continued)

FOREIGN PATENT DOCUMENTS

WO 2021034570 2/2021

*Primary Examiner* — Sundhara M Ganesan
*Assistant Examiner* — Zachary T Moore
(74) *Attorney, Agent, or Firm* — Billion & Armitage

(57) ABSTRACT

A free-standing retractable exercise system. The exercise system includes a base assembly and one or more exercise benches that extend away from an upright position to an extended position for use and retract into the upright position for storage. A pin releasably maintains the exercise system in the upright position and a distal leg maintains the exercise system in the extended position.

20 Claims, 15 Drawing Sheets

(56) References Cited

U.S. PATENT DOCUMENTS

| | | | | |
|---|---|---|---|---|
| 2003/0114281 | A1* | 6/2003 | Mackert | A63B 23/0494 482/142 |
| 2004/0018923 | A1* | 1/2004 | Schiff | A63B 21/4029 482/142 |
| 2005/0272574 | A1 | 12/2005 | Lessard | |
| 2006/0122045 | A1 | 6/2006 | Webber | |
| 2017/0239512 | A1* | 8/2017 | Brasch | A63B 21/4029 |
| 2020/0238143 | A1* | 7/2020 | Howell | A63B 67/06 |

* cited by examiner

RETRACTABLE EXERCISE SYSTEM

CROSS-REFERENCE TO RELATED APPLICATIONS

This application claims benefit of U.S. Provisional Application No. 63/284,157, filed on Nov. 30, 2021, and which application is incorporated herein by reference. A claim of priority is made.

TECHNICAL FIELD

This present disclosure relates to exercise equipment.

BACKGROUND

Weightlifting benches and rowing machines are typically used for human exercise and can be used with or without weights. Weightlifting benches typically provide a flat and/or inclined surface on which exercises are performed and are supported by one or more main beams that run longitudinally underneath the bench surface. The benches are adapted to support the weight of a human sitting or lying on the bench without constraining the arms and legs during exercise. Many benches employ support legs at either end of the bench for stability. Many exercise benches take up a lot of room and can be a burden.

SUMMARY

According to one aspect, an exercise system includes a base assembly comprising a base pivot; a main beam pivotally connected to the base assembly; a primary bench connected to the main beam, the primary bench comprising a first surface, a second surface opposite the first surface, a proximal end, and a distal end opposite the proximal end, wherein the first surface of the primary bench is configured to support a human sitting or lying thereon; a distal leg pivotally connected to the main beam; and a pin adapted to provide a temporary connection between the main beam and the base assembly. The exercise system is configured such that it operates in an upright position and extended position, where the upright position is defined by the longitudinal axis of the main beam at an angle less than thirty-five degrees with the vertical, wherein the upright position is maintained by the pin engaged between the main beam and the base assembly and the extended position is defined by the longitudinal axis of the main beam at an angle of less than forty-five degrees with the horizontal, wherein the extended position is maintained by the distal leg.

According to another aspect, an exercise system includes a base assembly comprising a base pivot; a main beam pivotally connected to the base assembly; a primary bench connected to the main beam, the primary bench comprising a first surface, as second surface opposite the first surface, a proximal end, and a distal end opposite the proximal end, wherein the first surface of the primary bench is configured to support a human sitting or lying thereon; a secondary bench pivotally connected to the main beam, the secondary bench comprising a first surface, a second surface opposite the first surface, a proximal end, and a distal end opposite the proximal end, wherein the first surface of the secondary bench is configured to support a human sitting or lying thereon; a distal leg pivotally connected to the main beam; and a rear support, the rear support adapted to contact the second surface of the secondary bench while the secondary bench is in the horizontal position. The exercise system is configured such that it operates in an upright position and extended position, where the upright position is defined by the longitudinal axis of the main beam at an angle less than thirty-five degrees with the vertical, wherein the upright position is maintained by the pin engaged between the main beam and the base assembly and the extended position defined by the longitudinal axis of the main beam at an angle of less than forty-five degrees with the horizontal, wherein the extended position is maintained by the distal leg.

According to another aspect, an exercise system includes a base assembly; a main beam pivotally connected to the base assembly; a primary bench connected to the main beam, the primary bench comprising a first surface, a second surface opposite the first surface, a proximal end, and a distal end opposite the proximal end, wherein the first surface of the primary bench is configured to support a human sitting or lying thereon; a distal leg pivotally connected to the main beam; a distal shaft rigidly connected to the distal leg; and a flexible element attached between the base shaft and the main distal shaft whereby the flexible element couples the rotational motion of the main beam to the rotational motion of the distal leg. The exercise system is configured such that it operates in an upright position and extended position, where the upright position is defined by the longitudinal axis of the main beam at an angle less than thirty-five degrees with the vertical, wherein the upright position is maintained by the pin engaged between the main beam and the base assembly, and the extended position defined by the longitudinal axis of the main beam at an angle of less than forty-five degrees with the horizontal, wherein the extended position is maintained by the distal leg.

DESCRIPTION OF DRAWINGS

FIG. 1 illustrates an upright position, FIG. 2 illustrates an intermediate position, and FIG. 3 illustrates an extended position.

FIG. 4 is a front view of an exemplary retracted position of the exercise system. FIG. 5 is a sectional view of FIG. 4 taken at line 5-5 which is a cutting plane right of center. FIGS. 6-7 are close-up views of FIG. 5.

FIG. 8 is a front view of an exemplary retracted position of the exercise system. FIG. 9 is a sectional view of FIG. 8 taken at line 9-9 which is a cutting plane left of center. FIGS. 10-11 are close-up views of FIG. 9.

FIG. 12 illustrates an upright position of the flexible element and FIG. 13 represents an extended position of the flexible element.

FIG. 14 is an end view of the retractable exercise system and FIG. 15 is a cross-sectional view of FIG. 14 taken at line 15-15.

FIG. 16 illustrates an upright position of the flexible element and FIG. 17 illustrates an extended position of the flexible element.

FIG. 19 illustrates a first angle for the bench; FIG. 20 illustrates a second angle for the bench; and FIG. 21 illustrates a third angle for the bench.

FIG. 26 is a section view of FIG. 25 taken at a line 26-26 which is a cutting plane right of center.

Like reference symbols in the various drawings indicate like elements.

DETAILED DESCRIPTION

Described herein are retractable exercise systems that are configured to be free-standing. The exercise system includes one or more exercise benches that extend away from an upright position. The upright position is used for saving space while the extended position is used for exercise. The invention can be easily extended to rowing machines, by permitting linear motion between a primary bench and the main beam.

Figure 1:
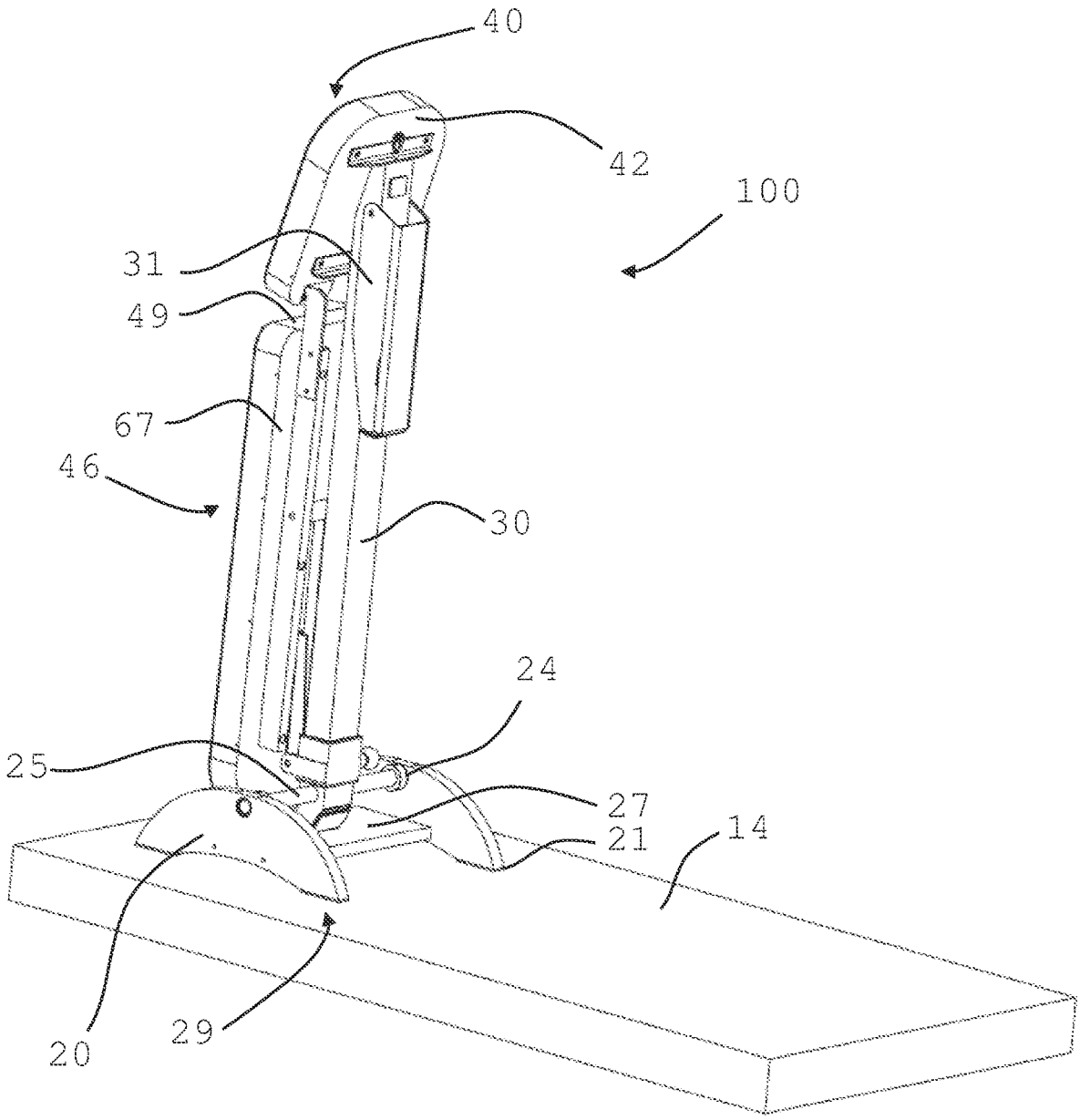
FIGS. 1-3 are illustrations of a retractable exercise system in different positions, according to some embodiments.
Figure 22:
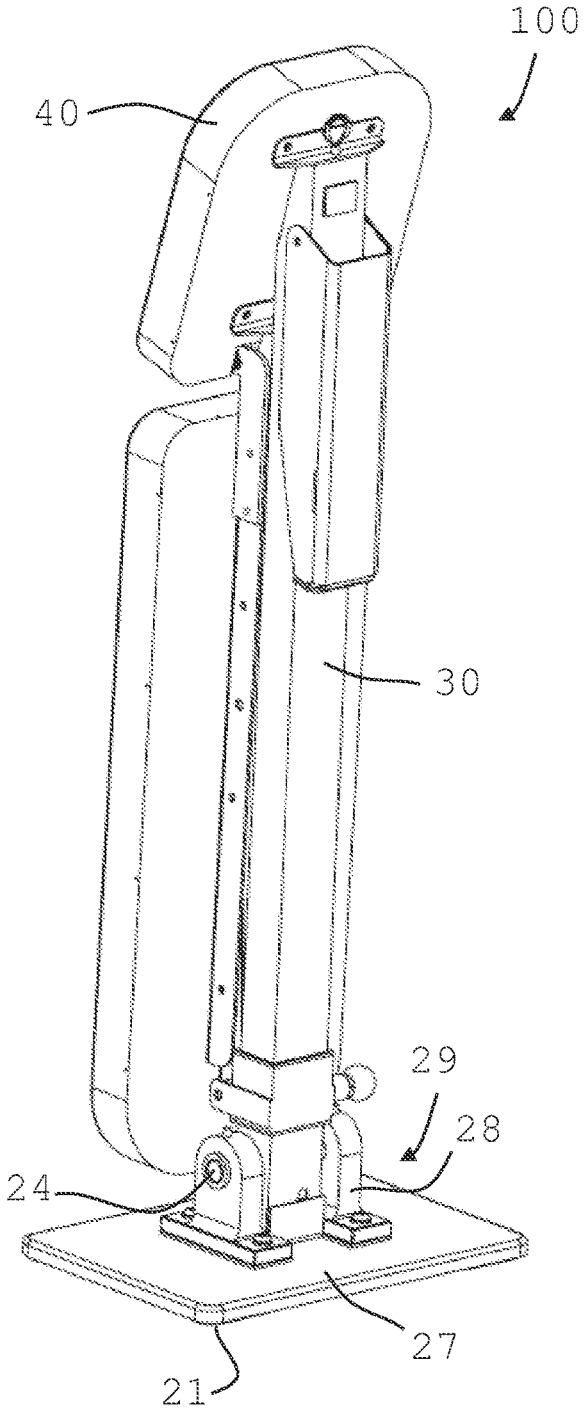
FIGS. 22-23 respectively show a top isometric view and a bottom isometric view of a exercise system with a base assembly according to some embodiments.
Figure 23:
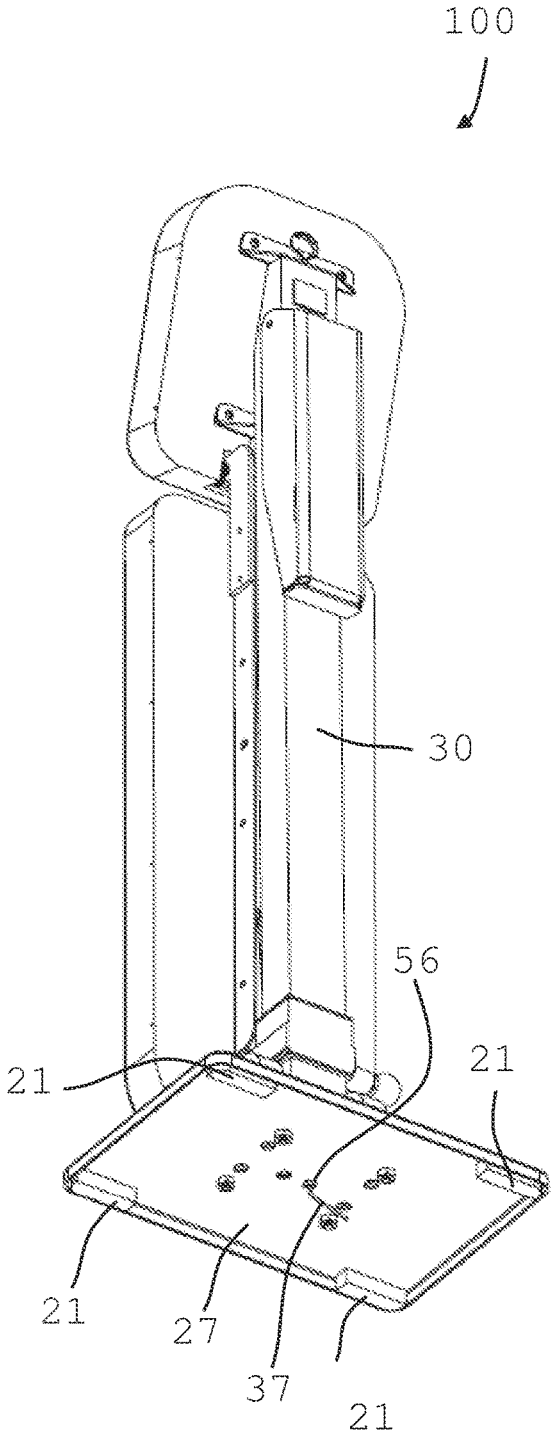

FIG. 1 is a perspective view of an exemplary exercise system 100 utilizing an incline bench configuration in an upright position (e.g., for storage). Exercise system 100 includes a base assembly 29. As shown in FIG. 1, the base assembly 29 includes rear legs 20, feet 21, a bridge 27, a base shaft 25, and a pivot 24, where the base shaft is rigidly connected to the main beam 30. In some embodiments, the main beam is longer than it is wide. Generally, the base assembly 29 has two primary functions, to provide a stable support in the upright position and to provide a pivot 24 around which the main beam 30 may rotate. In alternative configurations, the base shaft 25 may be rigidly fixed to the base assembly while the main beam 30 rotates pivotally about the base shaft 25. FIG. 22 and FIG. 23 show an alternative base assembly 29 where the bridge 27 interfaces directly with the feet 21 and mounted bearings 28 serve as the pivot 24. A mounted bearings 28 is defined as a bearing mounted to a piece of material. The pivot 24 of the mounted bearings can be made of ball bearings, bushings, or holes, so long as it provides a rotational joint between the mounted bearing 28 and the main beam 30. The mounted bearings 28 can be made as two separate pieces as shown in FIG. 22 or they can be made from a single piece.

Figure 2:
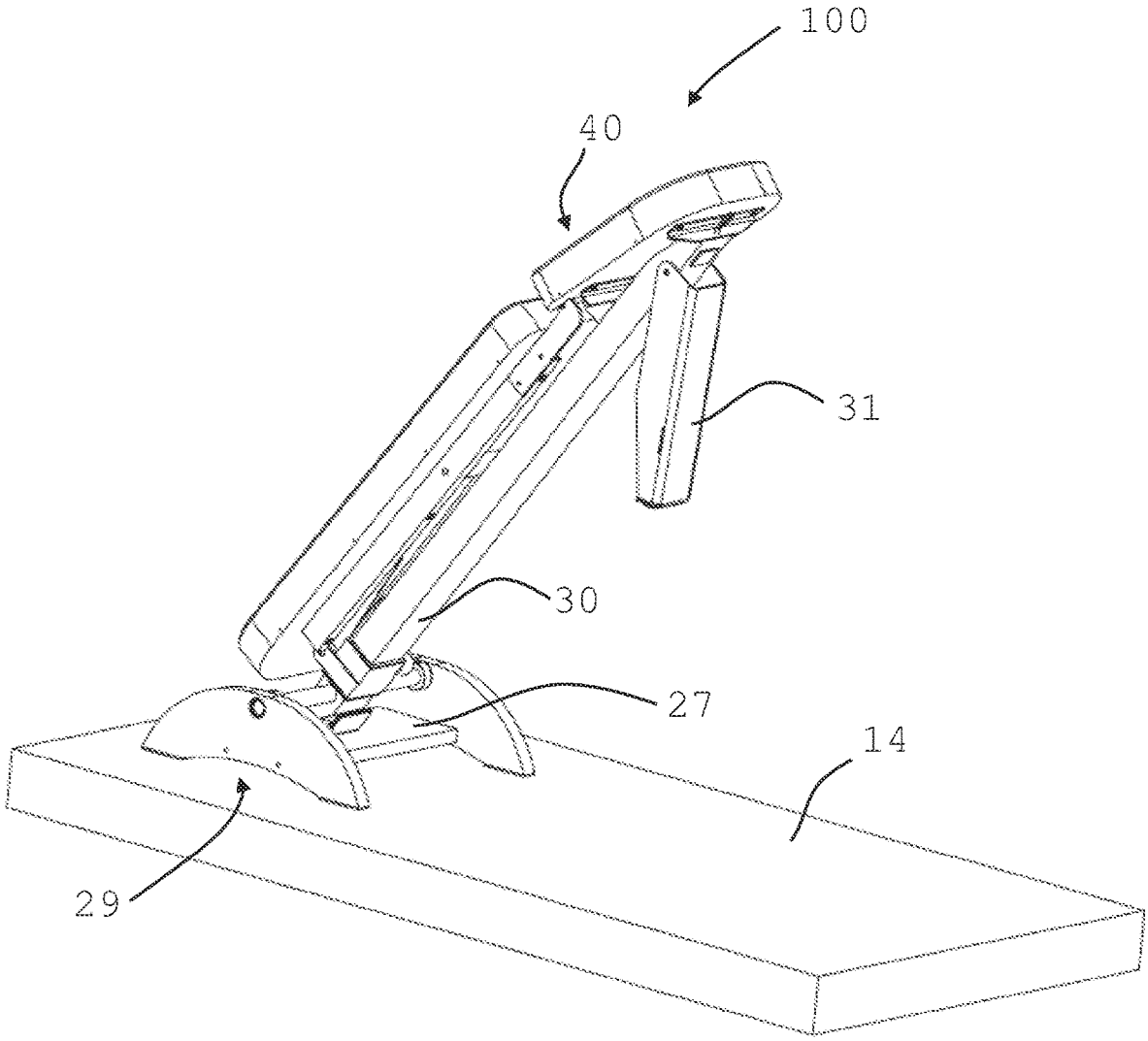
Figure 3:
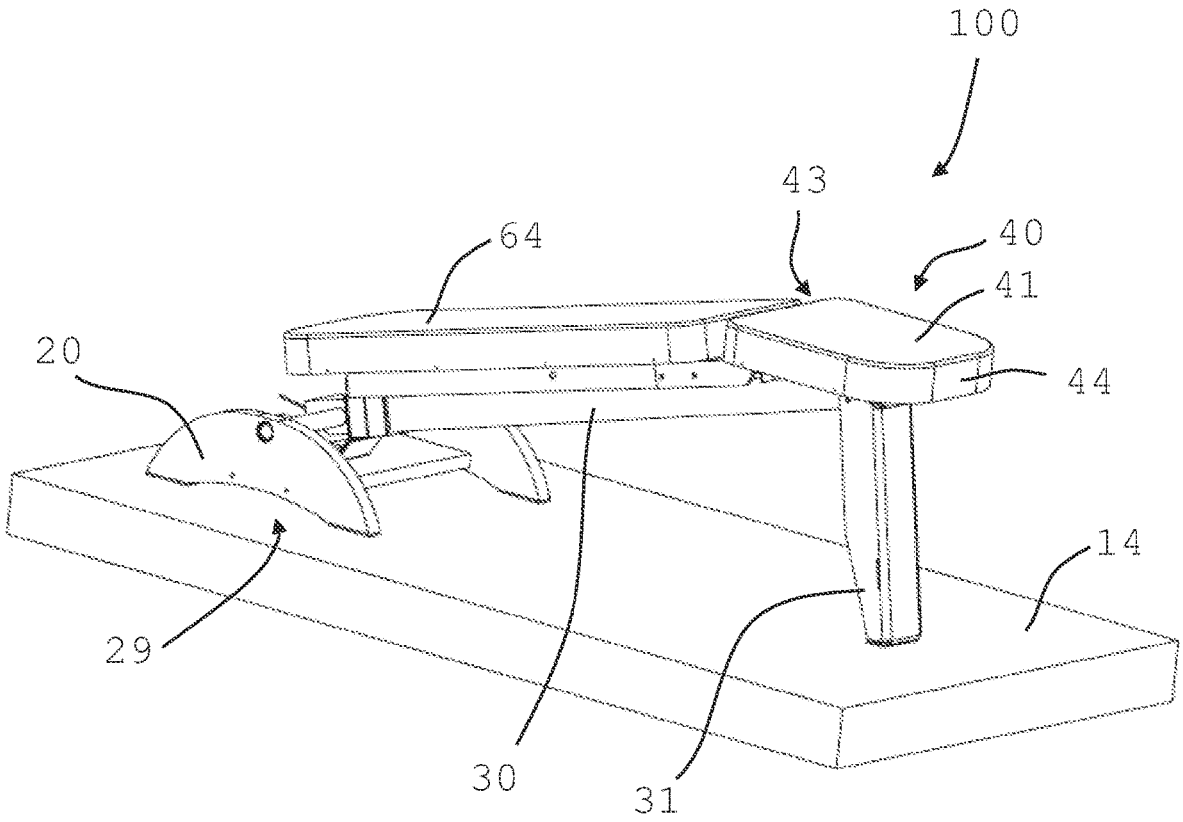

A primary bench 40 and a secondary bench 46 are attached to the main beam 30. In an alternative configuration, the exercise system has a single seating surface. For example, the primary bench and the secondary bench are a single bench. In some embodiments, the primary bench 40 is elongated to provide a single seating surface. In other embodiments, the secondary bench 46 is elongated to provide a single seating surface. Further, in another alternative configuration for use as a rowing machine, the primary bench 40 can be made to translate along the main beam 30. The main beam 30 can be a single beam or can be made from multiple beams working together. The primary bench can be constructed such that the main beam 30 and the primary bench 40 are made as a single part/integral. As seen in FIG. 2 and FIG. 3, the primary bench 40 includes a first surface 41 (e.g., a top surface on which a user lies or sits while performing exercise), a second surface 42 (e.g., a bottom surface) opposite the first surface, a proximal end 43, and a distal end 44 opposite the proximal end 43. The first surface 41 of the primary bench 40 is configured to support the weight of a human sitting or lying thereon. The secondary bench similarly includes a first surface 64 (on which the user lies or sits while performing exercises), a second surface 67 (e.g., a bottom surface), a proximal end 65, and a distal end 49.

As seen in FIG. 1, while the exercise system 100 is in an upright position, the main beam 30 is in a vertical or nearly vertical position for storage. Nearly vertical is defined as an angle of less than thirty-five degrees to a vertical plane that is perpendicular to the ground 14. In some embodiments, in the upright position, an incline support magnet 53 is used to keep the secondary bench at an angle of less than 10 degrees with the main beam 30 (see e.g., FIG. 9). The incline support magnet 53 may alternatively be placed directly on the second surface 67 of the secondary bench 46.

Figure 21:
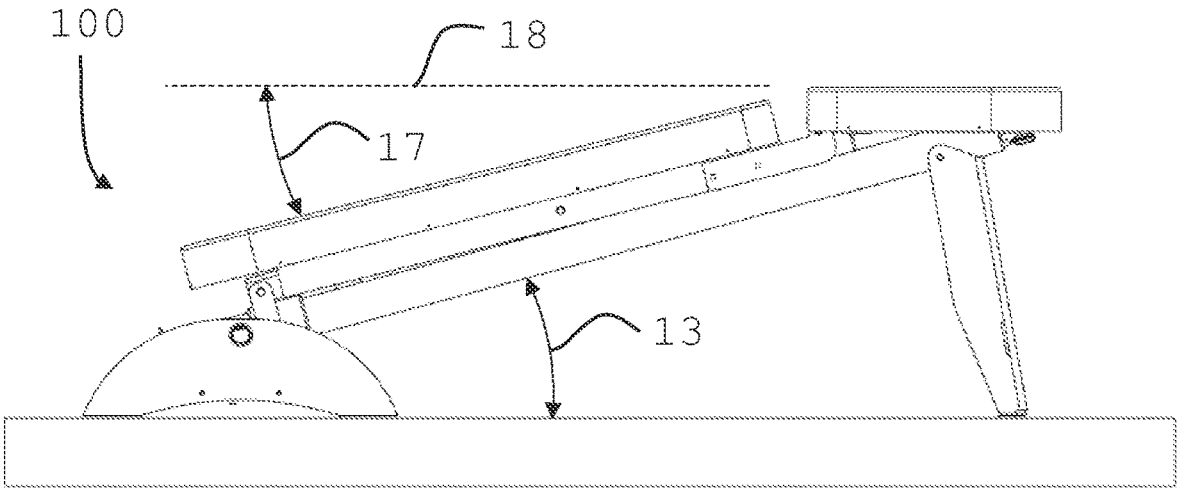

FIG. 2 shows the exercise system 100 in an intermediate position while the exercise system 100 is transitioned between the upright and the extended positions. The distal leg 31 is pivotally connected to the main beam 30 via a main distal shaft 33 (see e.g., FIGS. 5 and 9). FIG. 3 shows the exercise system 100 in an extended position (e.g., for exercise) in which the main beam 30 is horizontal or, as shown in FIG. 21, at an angle 13 of less than forty-five degrees with the floor.

Figure 15:
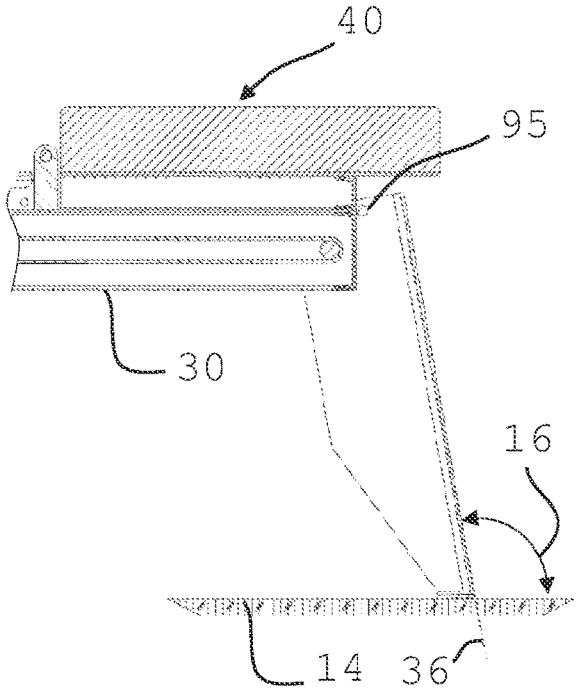

While the exercise system 100 is in the extended position, the distal leg angle 16 between the distal leg longitudinal axis 36 and the longitudinal axis of the main beam 30 is greater than or equal to ninety degrees (see e.g., FIG. 15). Referring back to FIG. 5, while the exercise system is in the upright position, the longitudinal axis 36 of the distal leg 31 and the longitudinal axis of the main beam 30 can be approximately parallel to one another, such that the angle between the longitudinal axis 36 of the distal leg 31 and the longitudinal axis of the main beam is less than forty-five degrees. The angle between the longitudinal axis of the distal leg and the longitudinal axis of the main beam can alternatively be less than 40°, less than 35°, less than 30°, less than 25°, less than 20°, less than 15°, less than 10°, or less than 5°, while the exercise system is in the upright position.

Figure 4:
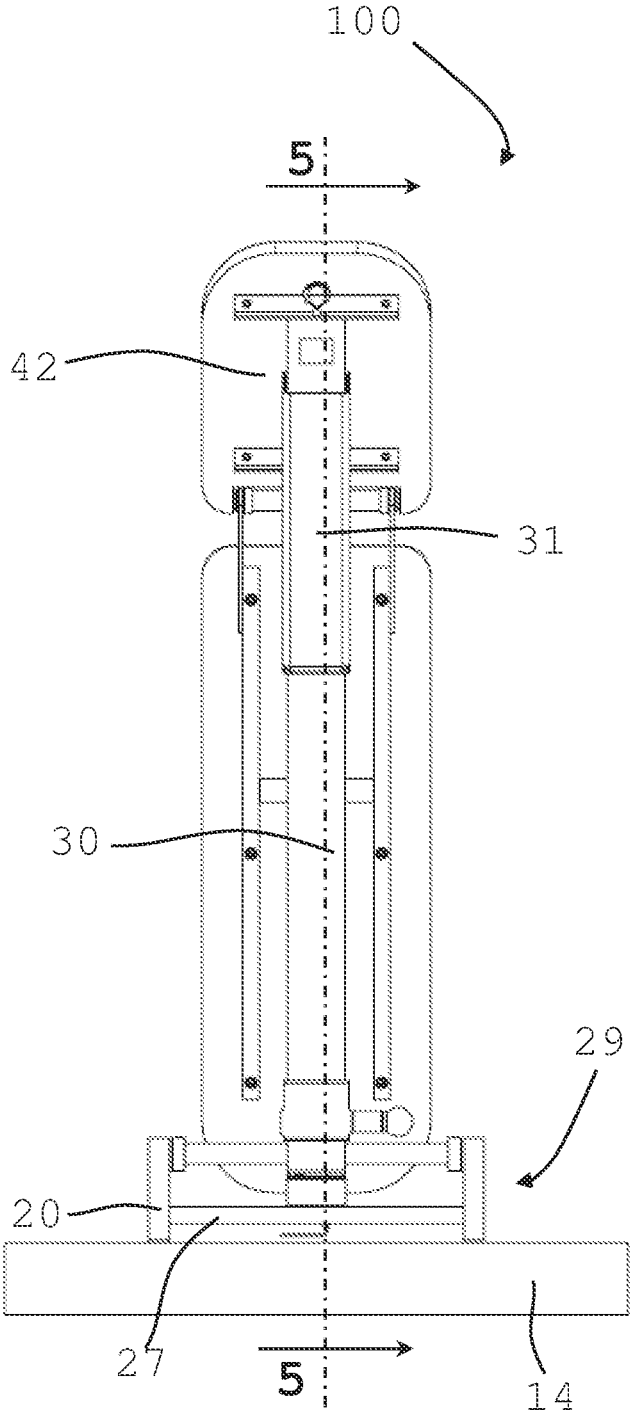
FIGS. 4-7 are illustrations of a flexible element assembly housed within the main beam of an exemplary retractable exercise system, according to some embodiments.
Figure 5:
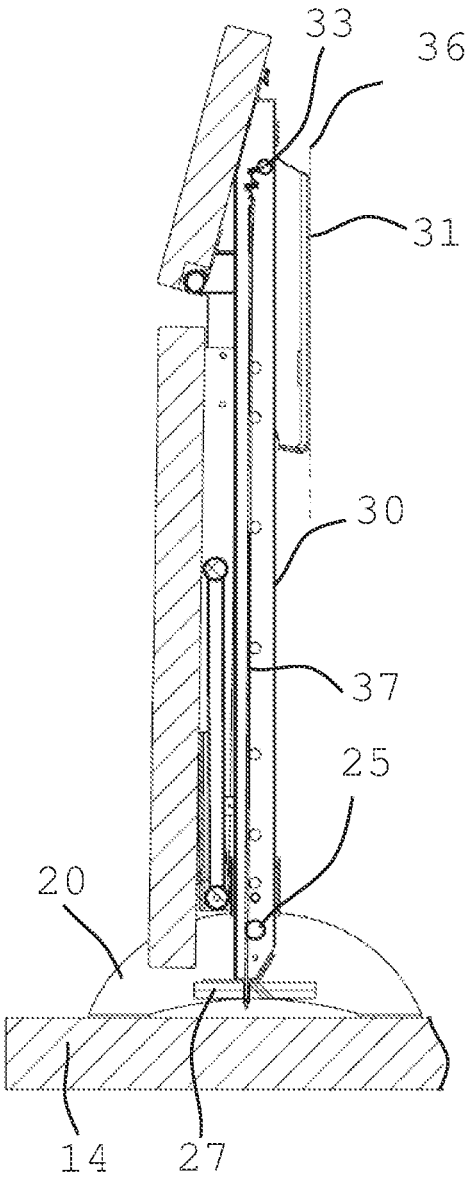

FIG. 4 is a front view of an exemplary retracted position of the exercise system 100 according to some embodiments. FIG. 5 is a sectional view of FIG. 4 at line 5-5 which defines an off-center cutting plane 5. A flexible element 37 is housed inside of the main beam 30, the flexible element running between the main distal shaft 33 and the base assembly 29 as shown in FIG. 5.

Figure 6:
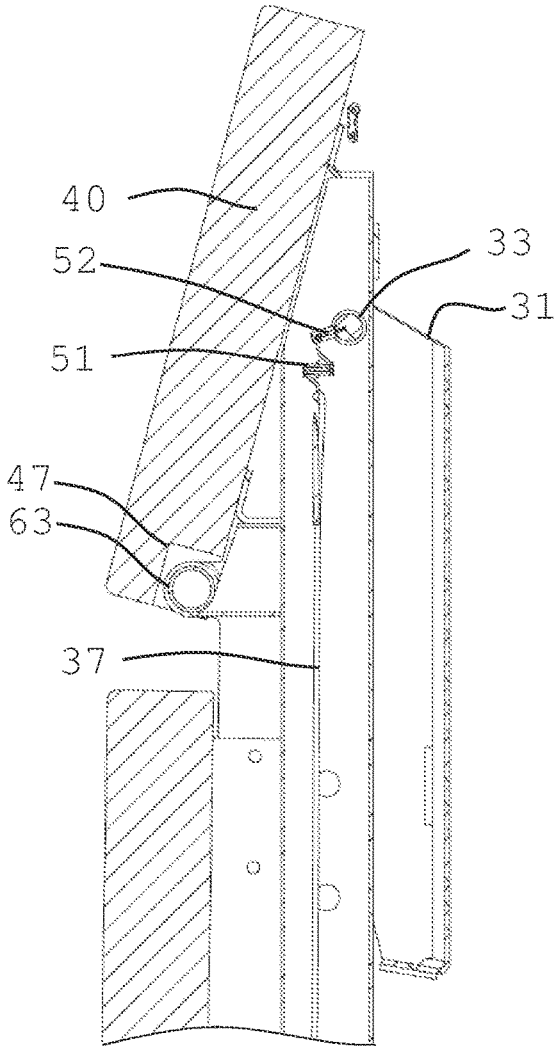

FIG. 6 shows a closer view of the section view of FIG. 5 focusing on the upper portion of the section view. In this exemplary configuration, the flexible element 37 connects to a spring 51. The spring 51 connects to the offset rod 52 which is rigidly mounted to the main distal shaft 33. The main distal shaft 33 is rigidly attached to the distal leg 31 such that the distal leg 31 rotates with the main distal shaft 33.

Figure 7:
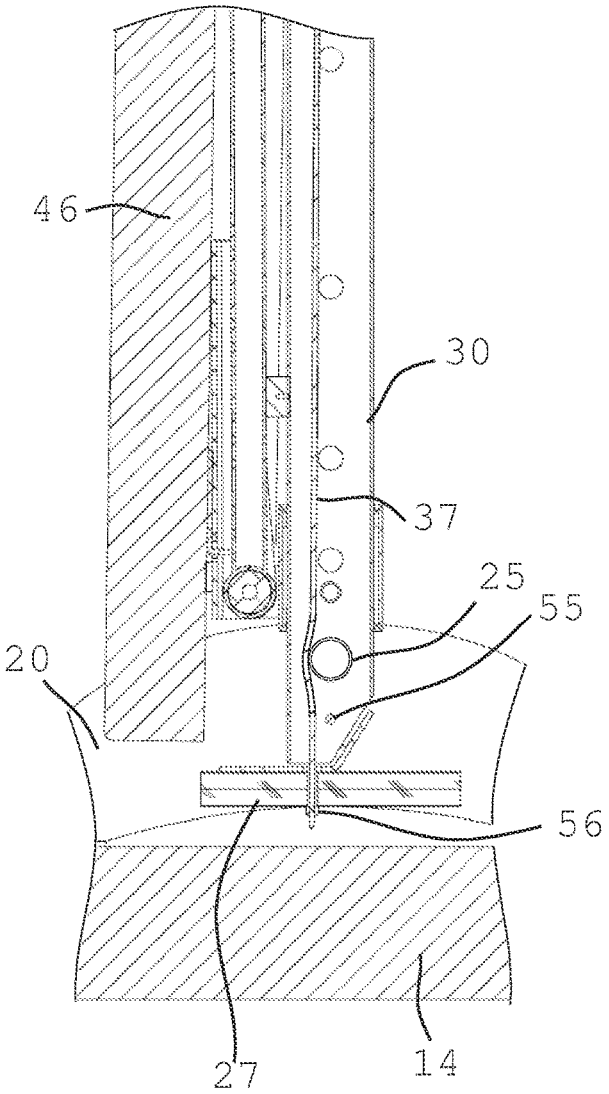

FIG. 7 shows a closer view of the section view of FIG. 5 focusing on the lower portion of the section view. In this exemplary configuration, the flexible element 37 passes through the bridge 27 of the base assembly 29 and is terminated on or below the base assembly. In this exemplary configuration, a screw collar 56 is used for termination. When the exercise system 100 is transitioned from the upright position to the extended position, the main beam 30 is rotated about the base shaft 25 (as configured in FIG. 7 the rotation is clockwise) and the idler shaft 55 contacts the flexible element 37, which effectively increases the length of the flexible element between the idler shaft 55 and the base shaft 25, shortening the available length of the flexible element 37 between the idler shaft 55 and the main distal shaft 33, which acts to rotate the main distal shaft and automatically moves the distal leg into the extended position. In this exemplary configuration, the offset rod 52 increases the mechanical advantage between the flexible element 37 and the main distal shaft 33. Spring 51 may maintain tension on the flexible element 37 at all times. This arrangement provides for a flexible-element-based automatic distal leg deployment. In some embodiments, both the offset rod 52 and the spring 51 are removed, which means that the flexible element is connected directly to the main distal shaft 33, and the mechanism will operate in the same way.

Figure 12:
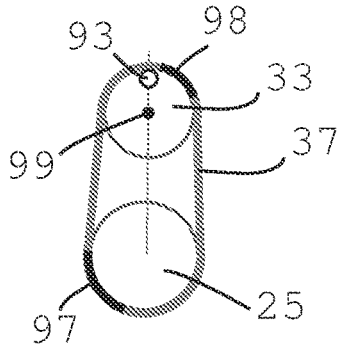
FIGS. 12-13 are views of a flexible element, according to some embodiments.

In some embodiments, a flexible-element-based automatic distal leg deployment is achieved by wrapping or attaching the flexible element 37 to the main distal shaft 33 on the upper portion of the assembly. In other embodiments, a flexible-element-based automatic distal leg deployment is achieved by wrapping or attaching the flexible element 37 to the base shaft 25 where the base shaft 25 is rigidly fixed to the base assembly 29. In this case, main beam 30 will be adapted to rotationally pivot about the fixed base shaft 25. An exemplary configuration of a flexible element 37 wrapped around main distal shaft 33 and base shaft 25 is shown in FIG. 12. This configuration serves the same purpose as adding a pulley rigidly attached to each shaft. The purpose of the flexible element 37 is to provide a non-slip connection between the two shafts and to link the rotational motion of the main beam 30 about the upper base shaft 25 to the rotational motion of the distal leg 31 about the main distal shaft 33.

Figure 13:
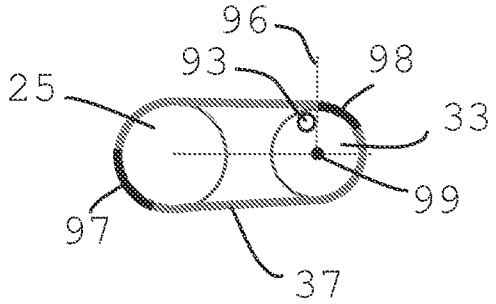
Figure 14:
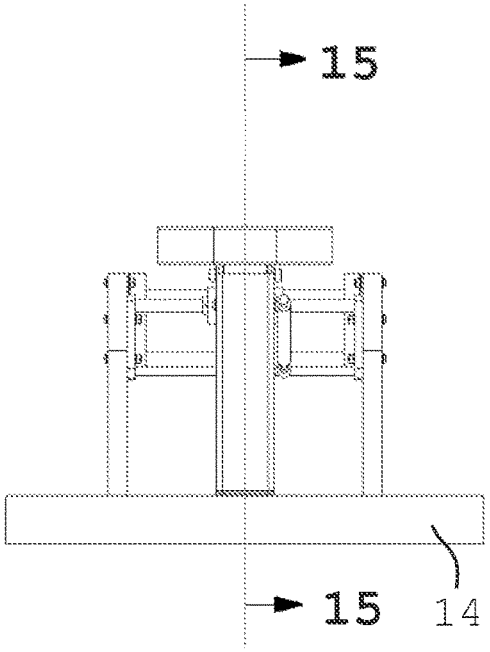
FIGS. 14-15 are views of a retractable exercise system according to some embodiments.

FIG. 12 and FIG. 13 show a schematic of the flexible element 37 connection using a shortened distance between the upper base shaft 25 and the main distal shaft 33. FIG. 12 represents the upright position. FIG. 13 represents the extended position. In this embodiment, the upper base shaft 25 is rigidly fixed to the base assembly 29 such that its rotational position is fixed. The distal leg 31 is rigidly attached to the main distal shaft 33 such that they rotate together. An imaginary circle 93 rotates with the main distal shaft 33 and is drawn on the main distal shaft 33 to show relative position between the vertical and upright position. In this exemplary configuration, the diameter of the main distal shaft 33 is smaller than the diameter of the upper base shaft 25 respectively to ensure that the main distal leg axis 36 is at an obtuse angle 16 to the floor 14 in the extended position, as seen in FIG. 15, by the imaginary circle traveling to the left of a vertical axis 96 of the main distal shaft 33 in the horizontal position as seen in FIG. 13.

The flexible element 37 can be fixed to the upper base shaft area 97 and the main distal shaft area 98 due to the limited rotational angle of the main shaft 30 to ensure a no-slip configuration. This fixture can be done by adhesive or fastener. Alternatively, the flexible element 37 can be wrapped one or more times around each pulley or shaft to use capstan forces for adhesion in combination, or instead of, a fastening method described above.

The flexible element 37 can be a belt, a cable, a strap, a string, a chain, toothed belt, or any other flexible power transmission element. The flexible element 37 may be inextensible or elastic.

Although not required for the mechanism to work properly, in some embodiments, a stop bar 95 is rigidly attached to the distal leg 31 to meet the main beam or a spacer beam 64 when the distal leg 33 is in its terminal angle 94 (see e.g., FIG. 15).

Figure 16:
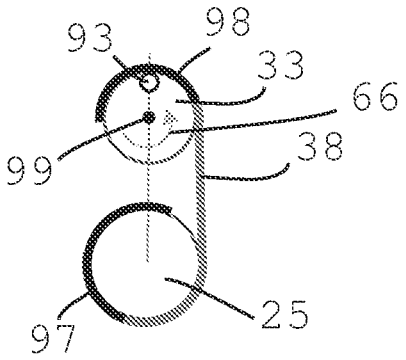
FIGS. 16-17 are views of a flexible element according to some embodiments.
Figure 17:
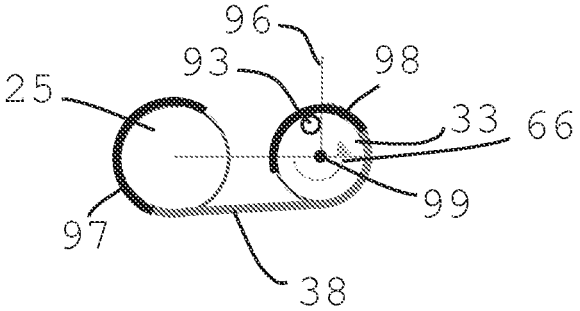

An alternative configuration of the flexible element arrangement is shown in FIG. 16 and FIG. 17. In this configuration, the single direction flexible element 38 is used in combination with a torsional spring that is represented by the direction of its torque 66. The torsional spring is oriented such that it reacts between the inside wall of the main beam 30 and the distal shaft 33 via a mount rigidly attached to the main distal shaft 33 and the torsional spring central axis 99 is mounted on the axis of the main distal shaft 33. In this configuration, the torsional spring would force the imaginary circle 93 to the left side of distal shaft vertical axis 96 in the extended position, while the flexible element 38 would act to draw the leg into the vertical direction in the upright position. In this configuration, a stop bar 95 as shown in FIG. 15 is included to limit motion of the leg. An advantage of this construction is to reduce the over-constraint that exists in the system shown in FIG. 12 and FIG. 13 when used with the stop bar 95.

In another configuration, the system shown in FIG. 16 and FIG. 17 is reversed such that the torsional spring acts to return the distal leg 33 into the vertical position in the upright position while the flexible element 38 moved the leg into the extended position in the extended position. In this configuration, the flexible element could be made to be axially stiff material such as a cable, chain, or stiff belt to limit rotation of the distal leg 31, or a stop bar 95 could be used to limit rotation.

Figure 8:
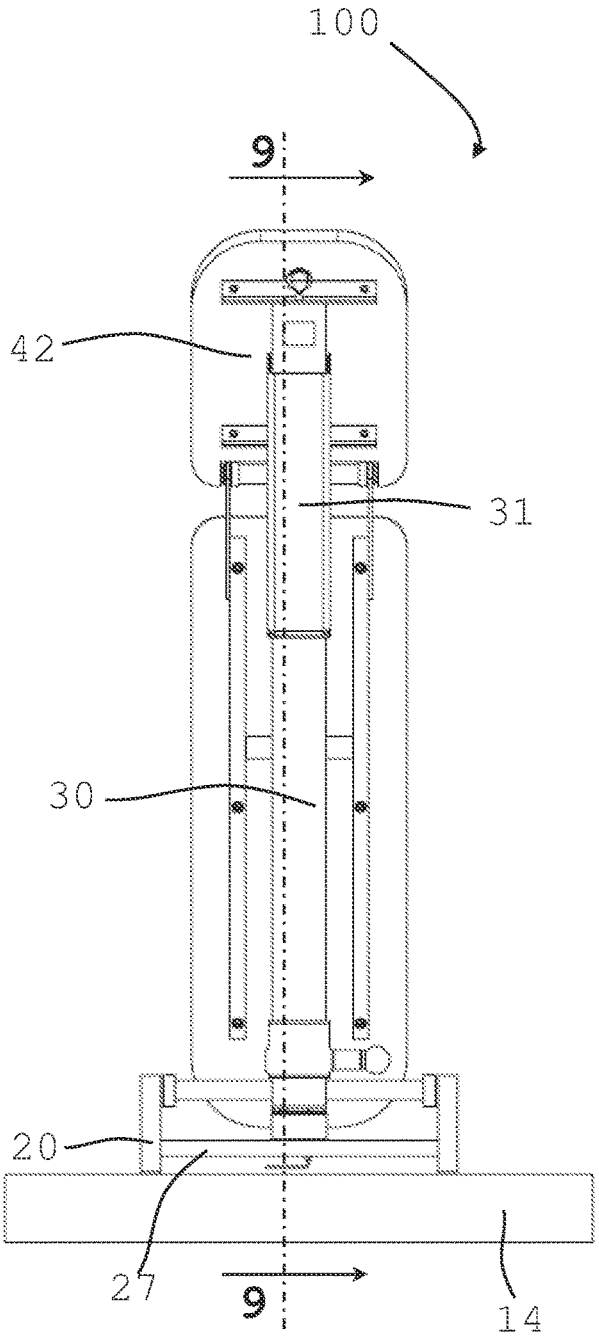
FIGS. 8-11 are illustrations of a flexible element assembly housed within the main beam of an exemplary retractable exercise system, according to some embodiments.
Figure 9:
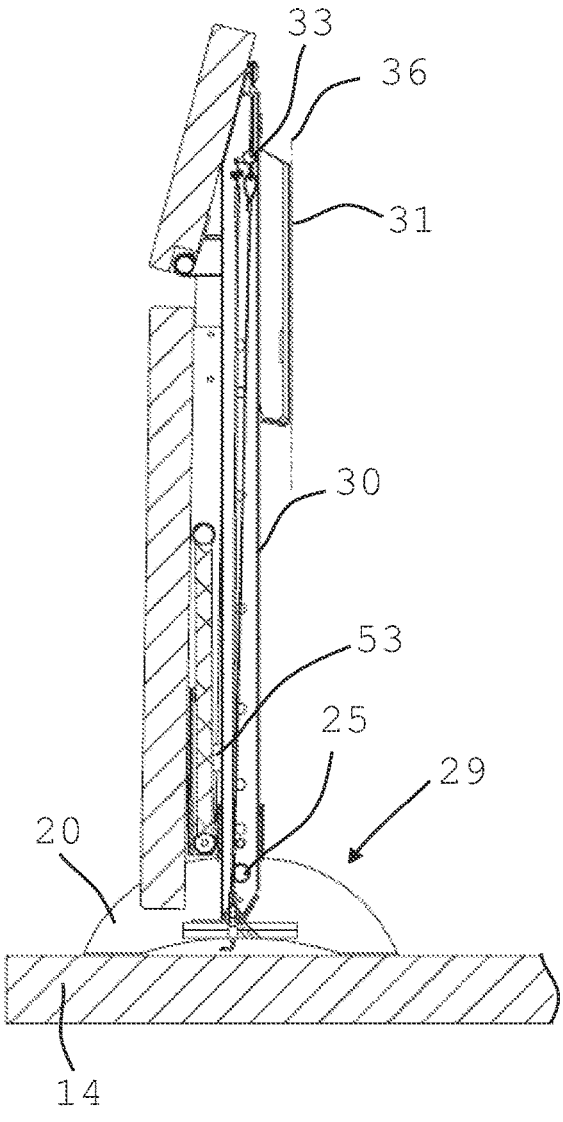
Figure 10:
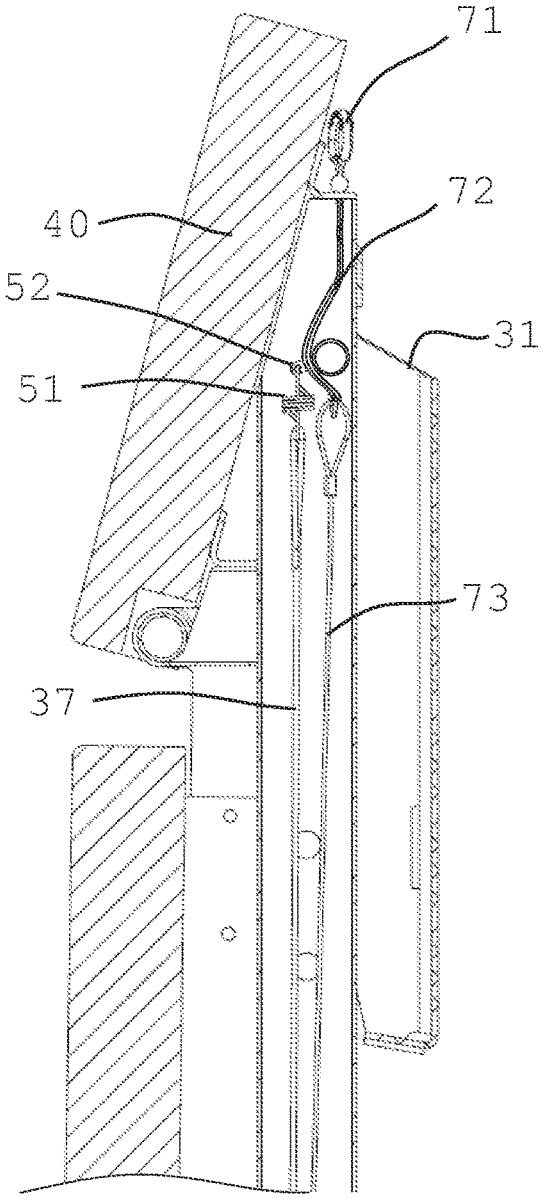
Figure 11:
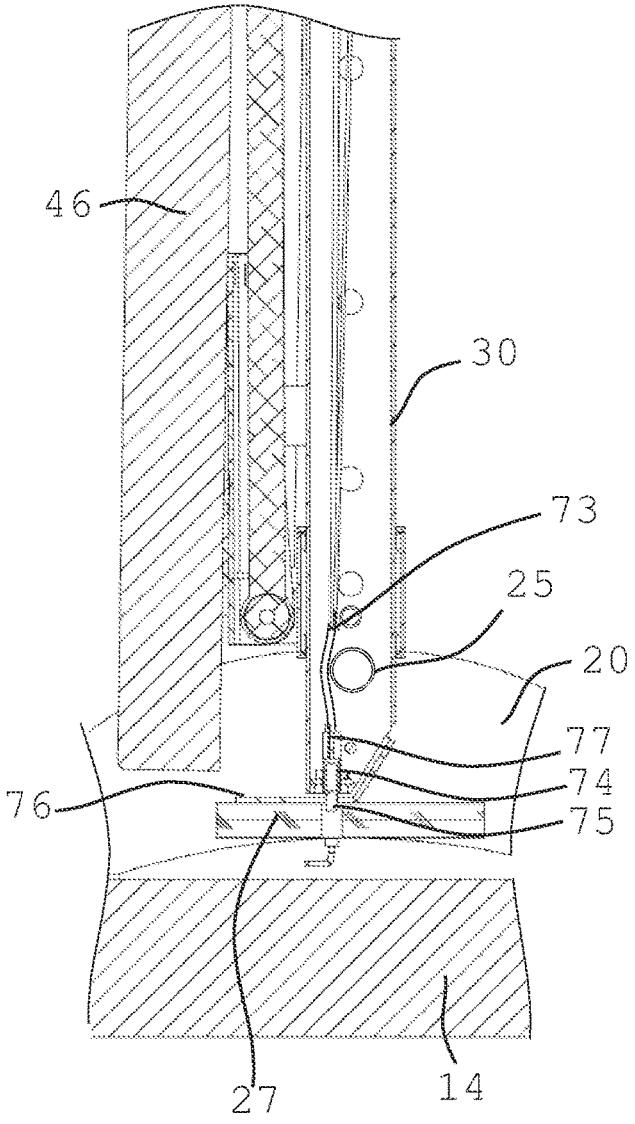
Figure 26:
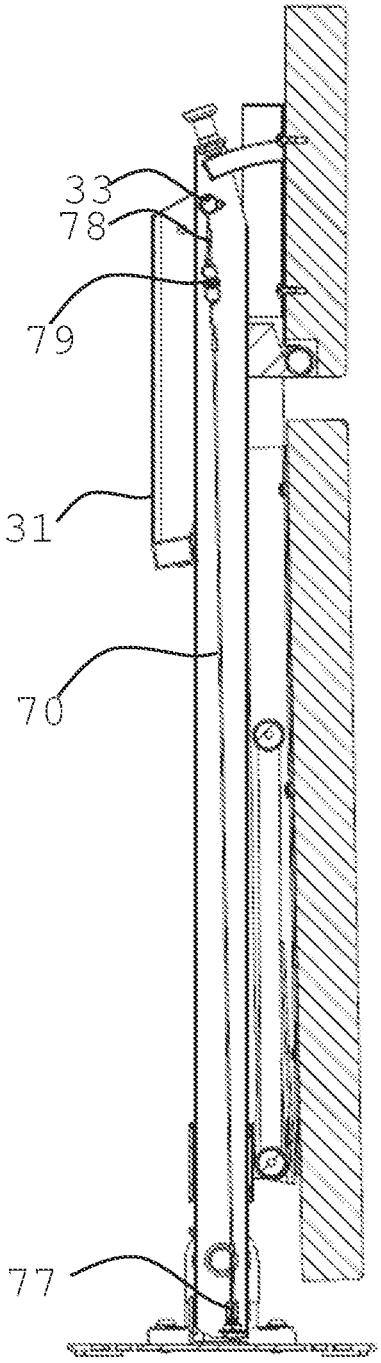

FIG. 8 is a front view of an exemplary retracted position of the exercise system 100. FIG. 9 is a sectional view of FIG. 8 at line 9-9 which defines an off-center cutting plane. FIG. 10 and FIG. 11 show a top portion and bottom portion respectively of the section view seen in FIG. 9. To lock the exercise system 100 in the upright position, a pin is used to provide a temporary connection between the main beam and the base assembly. In one configuration, a spring-loaded pin is used, the tip of the spring-loaded pin 75 protrudes through an orifice in the base assembly shown as a receiving plate 76. The orifice may also exist directly in the any part of the base assembly 26 that is horizontal to the ground such as the bridge 27. The housing of the spring-loaded pin 74 is fixed to the main beam 30 and contains a spring that extends the tip of the spring-loaded pin 75. A flexible cord 73 connects to the back side of the spring-loaded pin 77. The flexible cord may be constructed from one or more elements included in the following list: an inextensible cord, an extension spring, and elastic cord. FIG. 10 and FIG. 11 show the flexible cord 73 as a single inextensible cord. FIG. 26 shows the flexible cord as an assembly of an upper inextensible flexible cord 78, a flexible cord extension spring 79 and a lower inextensible flexible cord 70. The advantage of adding elasticity into the flexible cord is to reduce over-constraints in the system. A tensile force in the flexible cord 73, acts to retract the tip of the spring-loaded pin 75 into the housing of the spring-loaded pin 74 such that the tip of the spring loaded pin 75 no longer resides inside of the orifice in the receiving plate 76, thereby decoupling the connection between the main beam 30 and the receiving plate 76. The flexible cord 73 runs inside of the main beam 30 and connects to the pull tab 71.

In the exemplary configuration shown in FIG. 9 and FIG. 10, the pull tab 71 is connected to the flexible cord 73 via a pull tab string 72. The pull tab is adapted to be pulled by a user to apply tension to the flexible cord 73 thereby retracting the tip of the spring-loaded pin 75 and initiating the transition between the upright position and the extended position of the exercise system 100. The advantage of this locking topology is to keep the pull tab too high for small children to access.

In the exemplary configuration shown in FIG. 26, the flexible cord made of an upper inextensible flexible cord 78, a flexible cord extension spring 79 and a lower inextensible flexible cord 70 runs inside of the main beam 30 and connects between the distal shaft 33 and the back of the spring-loaded pin 77. The distal shaft 33 is rigidly connected to the distal leg 31. In this configuration, a user may pull the distal leg 31, which acts to apply tension to the flexible cord which retracts the tip of the spring-loaded pin tip 75, initiating the transition between the upright position and the extended position of the exercise system 100. The advantage of this locking topology is to keep the pin retraction mechanism high away from children while coupling the necessary opening of the distal leg with the pin retraction.

FIGS. 18-21 show different bench angle configurations of the exercise system 100. In this exemplary configuration, when the exercise system 100 is moved from the upright position to the extended position, the exercise system 100 will first have the configuration shown in FIG. 21 where the secondary bench angle 17 is below the horizontal 18. The secondary bench 46 is pivotally connected to the main beam 30 via the incline pivot 63 (see e.g., FIGS. 6 and 18). In an exemplary configuration, the secondary bench angle 17 can be altered by moving the slider 60 along the longitudinal axis of the main beam 30 (see e.g., FIG. 19). A spring-loaded pin is rigidly fixed to the slider and can be retracted by handle 68 (see e.g., FIG. 18). The spring-loaded pin (not shown) interfaces with holes in the main beam to define the secondary bench angle 17 (holes, not shown, are on the opposite side of the main beam 30). The incline support 48 is pivotally connected to the slider 60 via the slider pivot 62 (see e.g., FIG. 19). The incline support 48 is pivotally connected to the bench support beam 58 via the incline pivot 61. The incline support 48, and the two pivotal connections 62 and 61 define the secondary bench angle 17. Alternatively, the secondary bench angle 17 can be altered by moving the incline support 48 into a set of groves rigidly attached to the main beam 30.

Figure 18:
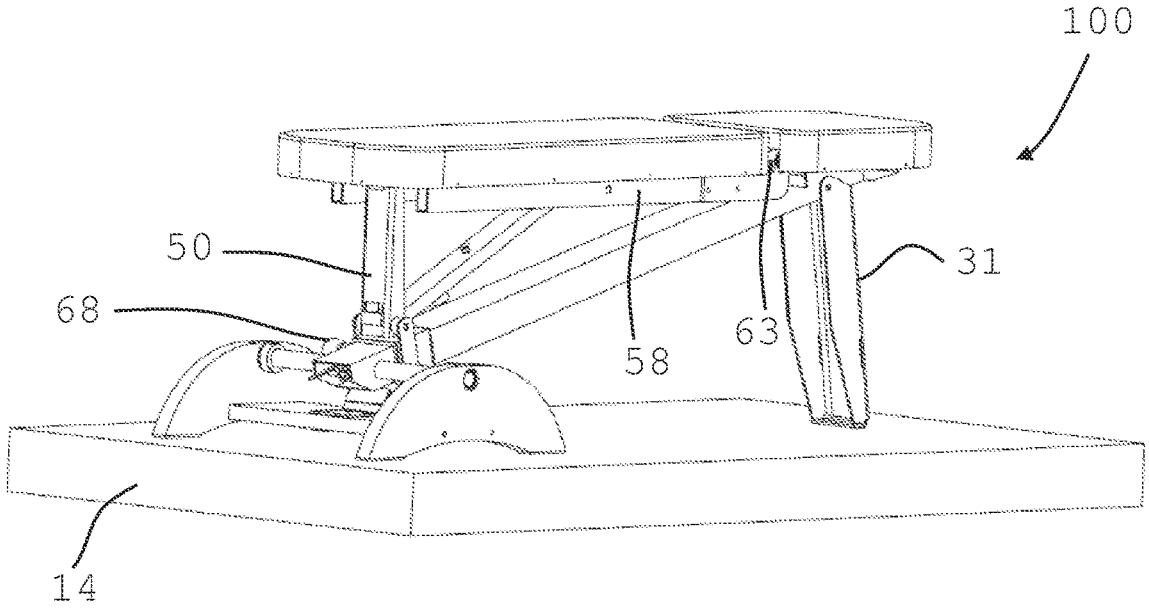
FIG. 18 is a rear isometric view of an exemplary retractable exercise system with a secondary bench in the flat position, according to some embodiments.
Figure 19:
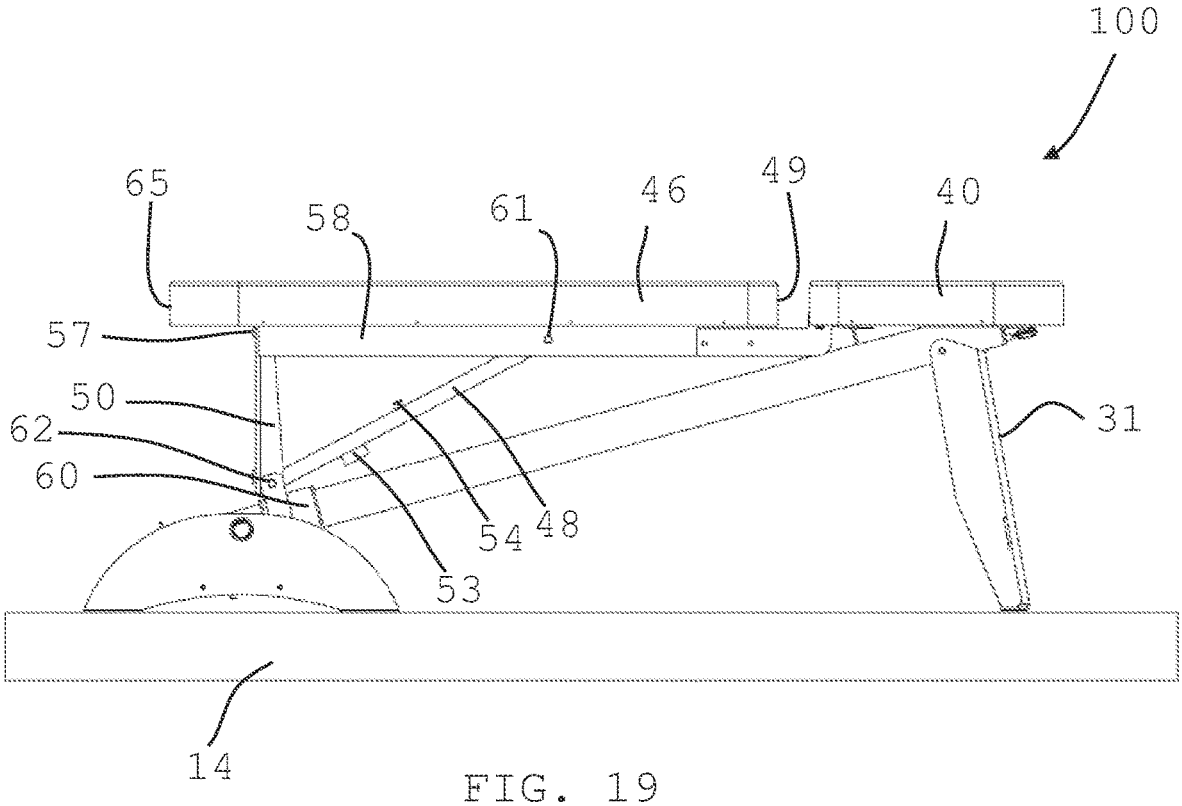
FIGS. 19-21 show different bench angle configurations for a retractable exercise system, according to some embodiments.
Figure 20:
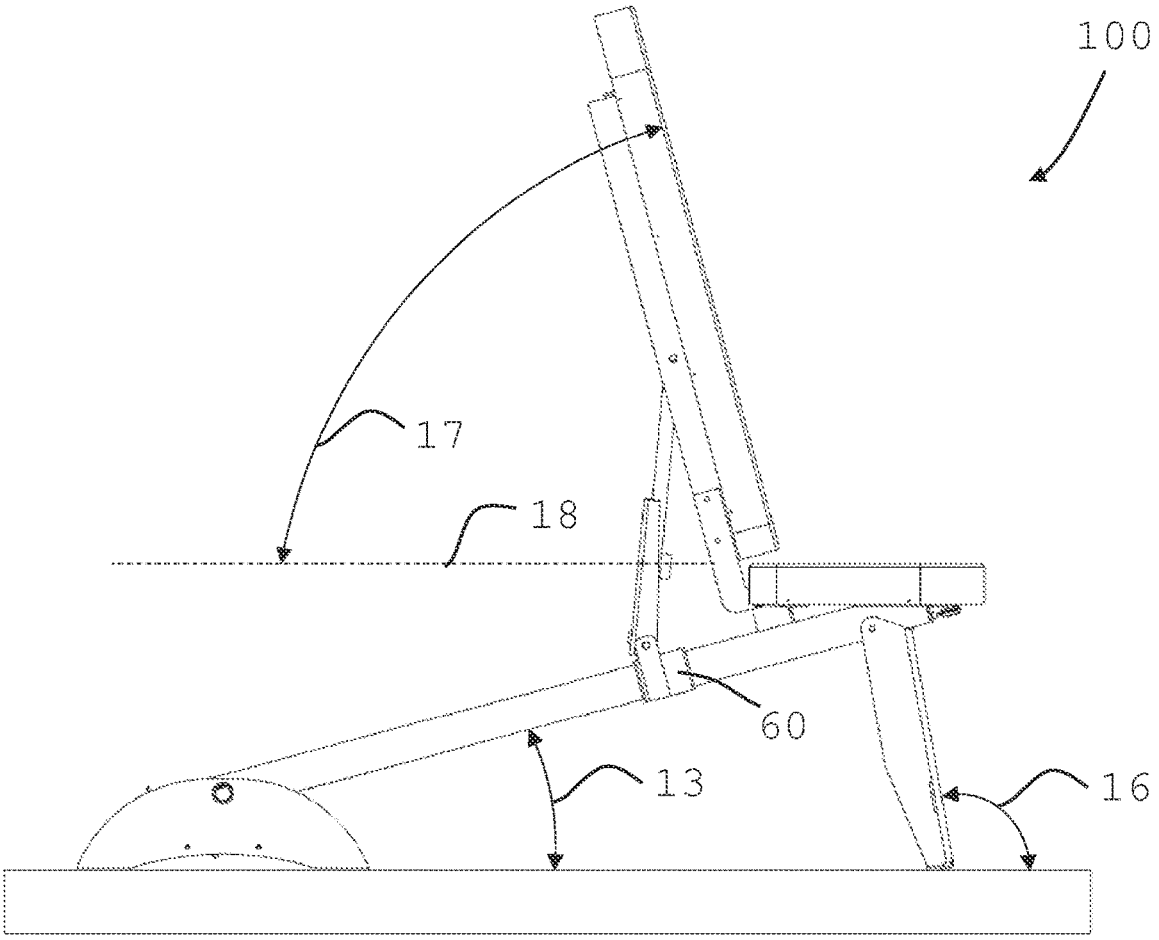

External loads applied to the exercise system will be maximum in the horizontal position shown in FIG. 18 and FIG. 19. In an exemplary configuration, a rear support 50 is pivotally connected to the slider 60 via the slider pivot 62 and is adapted to create a direct path between the second surface 67 of the secondary bench 46 and the slider 60, thereby increasing stiffness and strength of the exercise system 100. When the rear support 50 is rotated away from the incline support 48 into the support position, its rotation is terminated by an underside protrusion 57 that is rigidly connected to the second surface 67 of the secondary bench 46. Alternatively, the rear support 50 rotation is terminated by the rear support 50 contacting the slider 60. The rear support can be used with a spring that causes the rear support to extend automatically when the secondary bench 46 is rotated from the initial position as seen in FIG. 21 to the horizontal position seen in FIG. 19. The rear support 50 can be rotated to a stowed position adjacent to the incline support 48 when not in use, as is shown in FIG. 20 and FIG. 21. It should be understood that the rear support 50, while shown in combination with a slider 60, can be easily adapted to rotate directly about the incline support 48, the main beam 30, the base shaft 50 or about another rotational point attached to the base assembly 29. In some embodiments, a rear support magnet 54 is used to keep the rear support 50 in contact with the incline support 48 in the stowed position. In at least one embodiment, the rear support 50 is a feature of an inclining exercise bench that uses a slider 60 for angle adjustment regardless of the bench being configured to be retractable.

In some embodiments, a cutout feature 47 in the proximal end 43 of the primary bench 40 permits the incline pivot 63 to be moved underneath the first surface 41 of the primary bench 40, thereby storing the incline pivot 63 and reducing the distance between the proximal end of the primary bench 40 and the distal end 49 of the secondary bench 46 (see e.g., FIG. 6). In at least one embodiment, the cutout feature 47 is a feature of an inclining exercise bench that uses a primary bench 40 and a secondary bench 46 for angle adjustment regardless of the bench being configured to be retractable.

Figure 24:
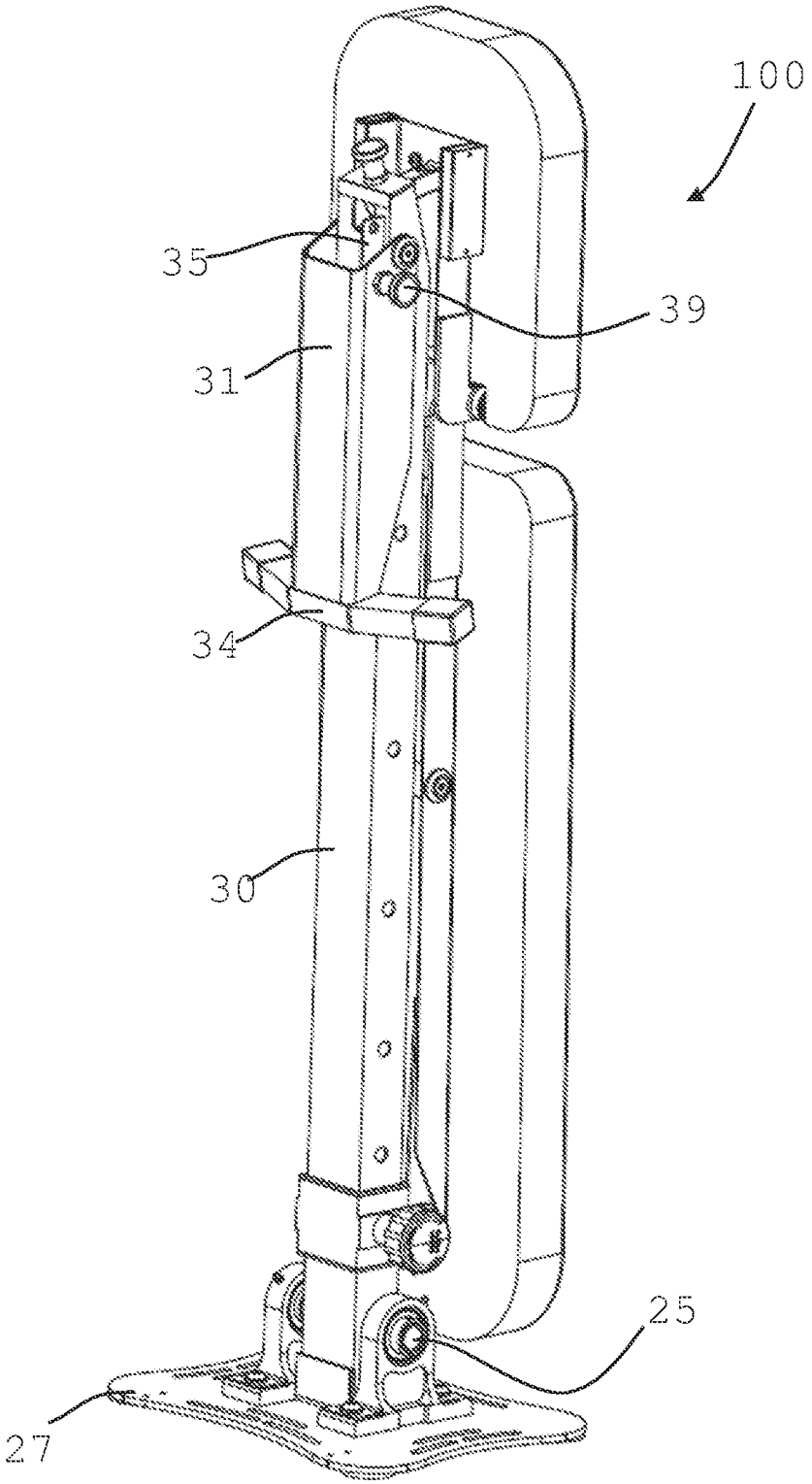
FIG. 24 is an isometric view of a retractable exercise system with a side-pin engaged using an elongated base assembly bridge and a widened distal leg according to some embodiments.
Figure 25:
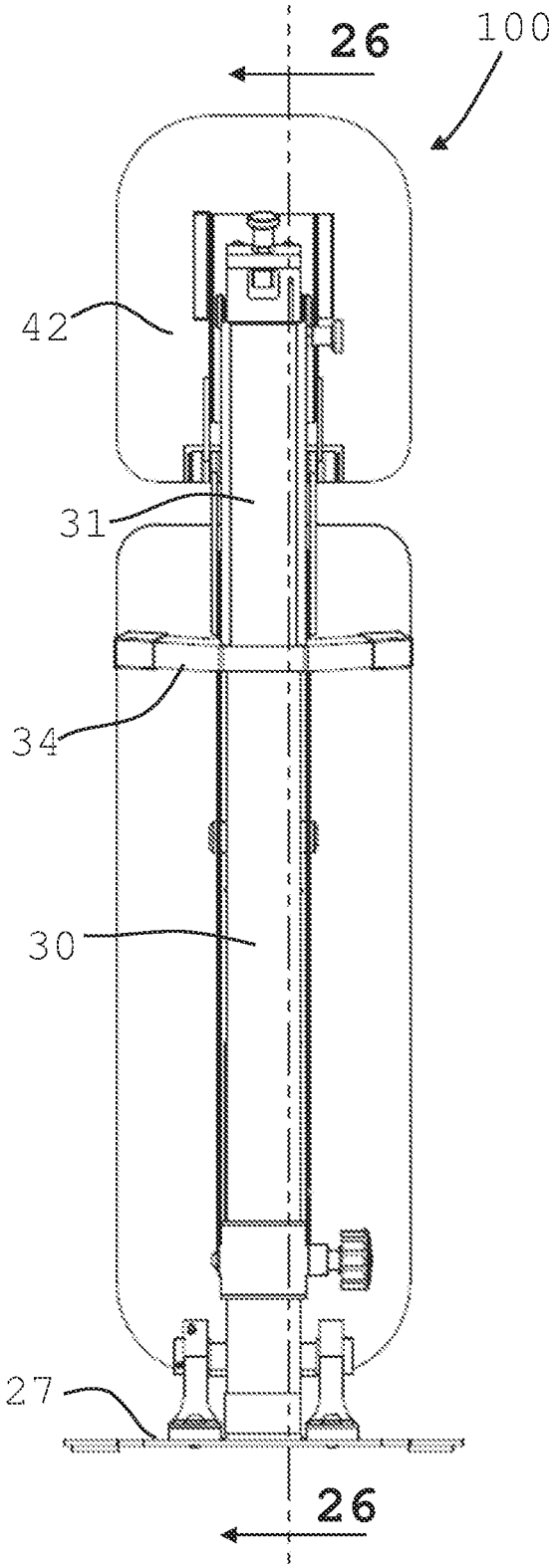
FIG. 25 and FIG. 26 are views of a flexible cord housed within the main beam of a retractable exercise system according to some embodiments.
Figure 27:
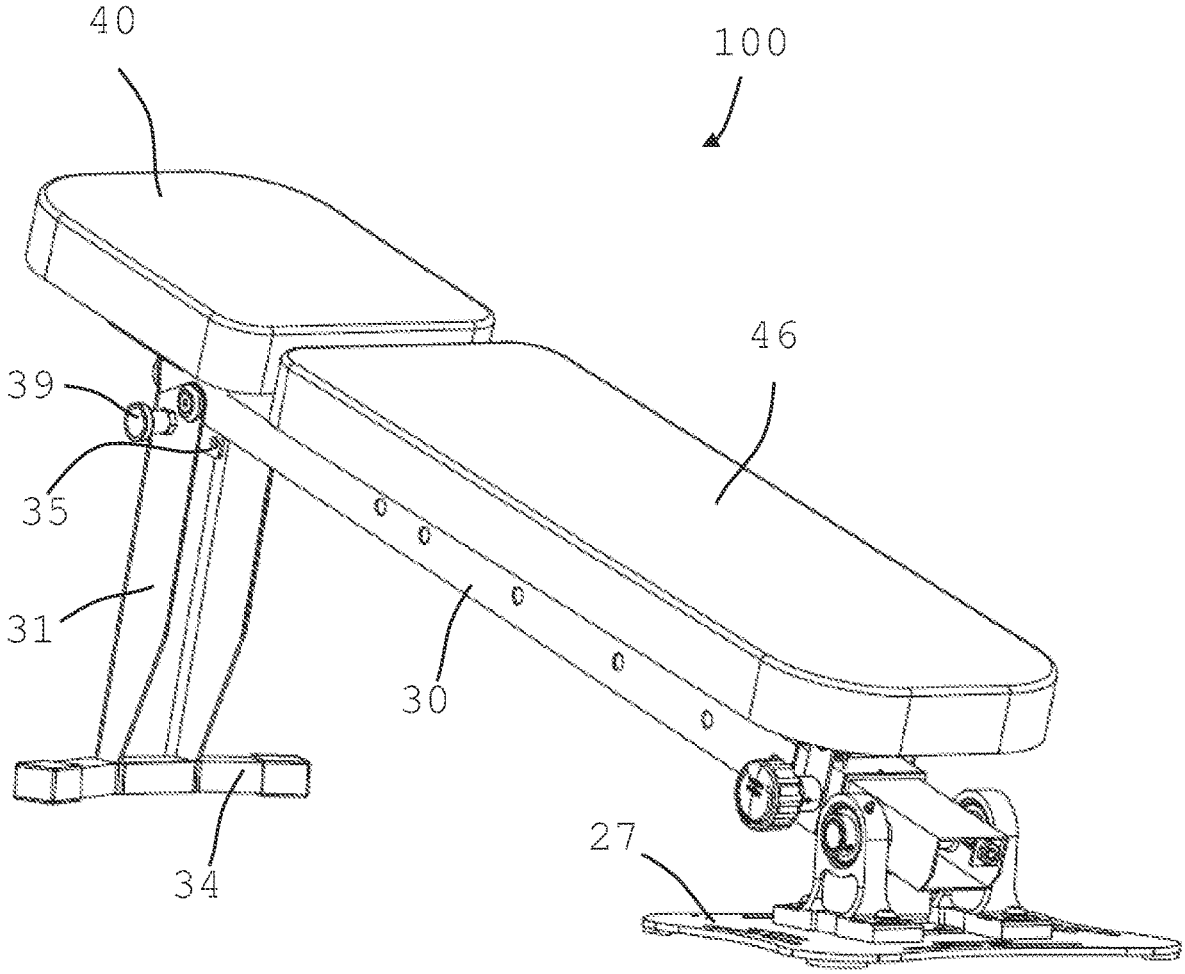
FIG. 27 is a rear isometric view of a retractable exercise system in an extended position according to some embodiments.

In all configurations, a side-pin 39 may be used to lock the position of the distal leg in the upright position and the extended position. FIG. 24 shows the exercise system in the upright position with the side-pin 39 engaged one hole of the pin plate 35. FIG. 27 shows the system in the extended position with the side-pin engaged in a different hole in pin plate 35 showing an extended foot beam 34 rigidly attached to the distal leg 31 for added stability.

A number of implementations have been described. Nevertheless, it will be understood that various modifications may be made without departing from the spirit and scope of the techniques and devices described herein. Accordingly, other implementations are within the scope of the following claims.

What is claimed is:

1. An exercise system, comprising:

a base assembly;

a main beam pivotally connected to the base assembly, the main beam comprising a longitudinal axis;

a primary bench connected to the main beam, the primary bench comprising a first surface, a second surface opposite the first surface, a proximal end, and a distal end opposite the proximal end, wherein the first surface of the primary bench is configured to support a human sitting or lying thereon;

a distal leg pivotally connected to the main beam; and a pin adapted to provide a temporary connection between the main beam and the base assembly; wherein:

the exercise system includes an upright position and an extended position;

wherein the longitudinal axis of the main beam is oriented at an angle less than thirty-five degrees to vertical when the exercise system is in the upright position, wherein the upright position is maintained by the temporary connection provided by the pin;

wherein the longitudinal axis of the main beam is oriented at a second angle of less than forty-five degrees to horizontal when the exercise system is in the extended position, wherein the extended position is maintained by the distal leg; and wherein rotational movement of the distal leg is coupled to the temporary connection such that the temporary connection occurs only in the upright position.

2. The exercise system of claim 1, wherein the connection between the primary bench and the main beam is rigid.

3. The exercise system of claim 1, further comprising a secondary bench pivotally connected to the main beam, the secondary bench comprising a first surface, a second surface opposite the first surface, a proximal end, and a distal end opposite the proximal end, wherein the first surface of the secondary bench is configured to support the human sitting or lying thereon.

4. The exercise system of claim 3, further comprising a rear support adapted to contact the second surface of the secondary bench when the secondary bench is in a horizontal position.

5. The exercise system of claim 4, wherein a spring automatically extends the rear support when the second bench is rotated from an initial position to the horizontal position.

6. The exercise system of claim 4, further comprising a magnet to maintain the rear support in a stowed position when the exercise system is in the upright position.

7. The exercise system of claim 1, wherein the connection between the primary bench and the main beam is pivotal such that the primary bench can rest at more than one angle.

8. The exercise system of claim 1, wherein the pin is spring loaded, the spring-loaded pin comprising a housing, a spring, and the pin.

9. The exercise system of claim 8, wherein the spring-loaded pin housing is connected to the main beam and a tip of the pin is adapted to slide through an orifice in the base assembly to lock the exercise system in the upright position.

10. The exercise system of claim 9, further comprising a flexible cord comprising one or more elements, with one end of the flexible cord connected to a back side of the spring loaded pin, wherein the flexible cord is adapted to withstand a tensile load to retract the spring loaded pin.

11. The exercise system of claim 10, further comprising a distal shaft rigidly connected to the distal leg, and an other end of the flexible cord is attached to the distal shaft such that rotational movement of the distal leg retracts the spring-loaded pin.

12. An exercise system, comprising:

a base assembly comprising a base pivot;

a main beam pivotally connected to the base assembly, the main beam comprising a longitudinal axis;

a primary bench connected to the main beam, the primary bench comprising a first surface, a second surface opposite the first surface, a proximal end, and a distal end opposite the proximal end, wherein the first surface of the primary bench is configured to support a human sitting or lying thereon;

a secondary bench pivotally connected to the main beam, the secondary bench comprising a first surface, a second surface opposite the first surface, a proximal end, and a distal end opposite the proximal end, wherein the first surface of the secondary bench is configured to support the human sitting or lying thereon;

a distal leg pivotally connected to the main beam;

a rear support configured to pivot upwards to contact the second surface of the secondary bench when the secondary bench is in a horizontal position; wherein:

the exercise system includes an upright position and an extended position;

wherein the longitudinal axis of the main beam is oriented at an angle less than thirty-five degrees to vertical when the exercise system is in the upright position, wherein the upright position is maintained by a pin engaging the main beam and the base assembly; and wherein the longitudinal axis of the main beam is oriented at a second angle of less than forty-five degrees to horizontal when the exercise system is in the extended position, wherein the extended position is maintained by the distal leg.

13. The exercise system of claim 12, wherein a spring is used to automatically extend the rear support when the secondary bench is rotated from an initial position to the horizontal position.

14. The exercise system of claim 12, further comprising a magnet to maintain the rear support adjacent to the incline support when the exercise system is in the upright position.

15. The exercise system of claim 12, further comprising an incline support magnet configured to maintain the secondary bench at an angle of less than ten degrees to the main beam when the exercise system is in the upright position.

16. The exercise system of claim 12, wherein the pin is spring loaded, the spring loaded pin comprising a housing, a spring, and the pin.

17. The exercise system of claim 16, wherein the spring-loaded pin housing is connected to the main beam and a tip of the pin is adapted to slide through an orifice in the base assembly to lock the exercise system in the upright position.

18. The exercise system of claim 17, further comprising a flexible cord constructed of one or more elements, wherein a first end of the flexible cord is connected to a back side of the spring loaded pin, the flexible cord adapted to withstand a tensile load to retract the spring loaded pin.

19. The exercise system of claim 18, further comprising a distal shaft rigidly connected to the distal leg, a second end of the flexible cord is connected to the distal shaft such that retraction of the spring-loaded pin is coupled to rotational movement of the distal leg.

20. The exercise system of claim 12, wherein the rear support is pivotally connected to a slider adapted to move along the longitudinal axis of the main beam.

* * * * *